US010006398B2

(12) United States Patent
Atterberry et al.

(10) Patent No.: US 10,006,398 B2
(45) Date of Patent: Jun. 26, 2018

(54) SYSTEM AND METHOD FOR ANALYZING FUEL FOR FLEET CALIBRATION

(71) Applicant: Caterpillar Inc., Peoria, IL (US)

(72) Inventors: Nathan P. Atterberry, Washington, IL (US); Matthew J. Engfehr, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 79 days.

(21) Appl. No.: 15/333,245

(22) Filed: Oct. 25, 2016

(65) Prior Publication Data

US 2018/0112622 A1 Apr. 26, 2018

(51) Int. Cl.

| | |
|---|---|
| ***F02D 43/00*** | (2006.01) |
| ***F02D 41/00*** | (2006.01) |
| ***F02D 41/26*** | (2006.01) |

(52) U.S. Cl.

CPC ..... *F02D 43/00* (2013.01); *F02D 41/0027* (2013.01); *F02D 41/26* (2013.01); *F02D 2200/0611* (2013.01); *F02D 2200/0625* (2013.01)

(58) Field of Classification Search

CPC ..... F02D 43/00; F02D 41/0027; F02D 41/26; F02D 2200/0611

See application file for complete search history.

(56) References Cited

U.S. PATENT DOCUMENTS

| | | | | |
|---|---|---|---|---|
| 5,044,337 | A * | 9/1991 | Williams | F02D 41/1444 123/436 |
| 5,697,346 | A | 12/1997 | Beck | |
| 6,612,269 | B2 | 9/2003 | Heffel et al. | |
| 6,947,830 | B1 | 9/2005 | Froloff et al. | |

(Continued)

FOREIGN PATENT DOCUMENTS

| | | |
|---|---|---|
| DE | 3410714 | 10/1985 |
| EP | 2469065 | 6/2012 |

(Continued)

*Primary Examiner* — Thomas Moulis

(74) *Attorney, Agent, or Firm* — Finnegan, Henderson, Farabow, Garrett & Dunner, LLP

(57) ABSTRACT

A control system for a multiple fuel internal combustion engine on a vehicle in a fleet of vehicles may include at least one gas analyzer configured to monitor real-time characteristics of gaseous fuel being supplied to the engine, a fleet management data monitoring module, and a cylinder pressure sensor associated with each cylinder of the engine. The control system may further include a data collection module configured to receive real-time fuel characteristics measurements from the gas analyzer, fleet data characteristic of one or more operational parameters, fuel usage, and performance results for vehicles in the fleet, and cylinder pressure measurements from each of the cylinder pressure sensors. An engine electronic control module may calculate one or more actual combustion parameter values from the real-time cylinder pressure measurements, assign weights to fuel characteristics data, cylinder pressure data, and fleet management data, and control at least one of fuel injection and ignition timing based on the weighted data and any difference between calculated actual combustion parameter values for each cylinder and predetermined combustion parameter values.

20 Claims, 4 Drawing Sheets

(56) References Cited

U.S. PATENT DOCUMENTS

| | | | | |
|---|---|---|---|---|
| 7,996,147 | B2 | 8/2011 | Gokhale | |
| 9,228,506 | B2 | 1/2016 | Gokhale et al. | |
| 2002/0103955 | A1* | 8/2002 | Ehrenhardt | G05B 19/042 710/301 |
| 2008/0006252 | A1* | 1/2008 | Kramer | F02D 13/0269 123/575 |
| 2008/0221774 | A1* | 9/2008 | Dagci | F02B 11/00 701/102 |
| 2008/0262701 | A1* | 10/2008 | Williams | F02D 19/0628 701/103 |
| 2010/0299051 | A1* | 11/2010 | Wang | F02D 35/023 701/111 |
| 2011/0046842 | A1* | 2/2011 | Smith | G07C 5/006 701/31.4 |
| 2011/0114058 | A1* | 5/2011 | Cohn | F02B 43/00 123/25 A |
| 2012/0253641 | A1 | 10/2012 | Warner et al. | |
| 2015/0224997 | A1* | 8/2015 | Glugla | F02D 41/2432 701/54 |
| 2016/0160776 | A1* | 6/2016 | Yeager | F02D 35/023 123/435 |
| 2016/0169132 | A1* | 6/2016 | Yeager | F02D 41/0027 701/103 |
| 2016/0169133 | A1* | 6/2016 | Yeager | F02D 41/0027 123/435 |

FOREIGN PATENT DOCUMENTS

| | | |
|---|---|---|
| WO | WO 2008/049890 | 5/2008 |
| WO | WO 2016/091523 | 6/2016 |

* cited by examiner

SYSTEM AND METHOD FOR ANALYZING FUEL FOR FLEET CALIBRATION

TECHNICAL FIELD

The present disclosure relates generally to a system and method for calibrating operational parameters for a fleet of vehicles, and more particularly, to a system and method for analyzing fuel for fleet calibration.

BACKGROUND

Gaseous fuel powered engines and engines that operate on multiple different fuels are used in a variety of applications. Fuels for diesel engines of motor vehicles, such as diesel, biodiesel or gas-to-liquid fuel, i.e. liquid fuel obtained from natural gas, have very different fuel qualities. In particular, the ignitability of the fuel, which is important for the combustion in the cylinders of diesel engines and is usually expressed as the cetane index CCI or the cetane number, can vary for different fuels. Even within the same types of fuel, combustion characteristics of the fuel such as the cetane index and octane number can vary. Engines that are capable of running on diesel and natural gas simultaneously, such as large mining trucks, need to be appropriately calibrated to meet regulatory requirements, business needs, and customer expectations. Some of the fuel, and in particular natural gas obtained from different sources and in different geographical regions, can vary in composition and qualitative or quantitative characteristics such as methane number, heating value, or octane number, and may therefore exhibit different resistances to knock or other performance parameters. Furthermore, in a fleet of vehicles operating at one or more job sites, global considerations such as the relative quantities, costs, and quality of the various available fuels at the one or more job sites, the relative ages and efficiencies of the various vehicles in the fleet, overall emission levels and regulatory requirements in particular geographical areas, and other fleet management parameters may affect the merit of using more or less of a particular fuel in a customer application. Therefore, a system and method is needed for identifying the properties of the fuel on a real-time basis, determining fleet management data relevant to a particular application, and communicating the results to engine controllers on each of the vehicles in a fleet. The engine controllers may be configured to use the information in combination with engine specific combustion parameters for modifying and calibrating operational parameters and settings of the individual engines on each vehicle.

An example of an internal combustion engine that can be reconfigured to operate with any given fuel from a range of combustible fuels is shown in U.S. Pat. No. 6,947,830 to Froloff et al. ("the '830 patent"). The '830 patent discloses a programmable computer system for an internal combustion engine configured to receive and process fuel combustion characteristic signals and data from various combustion events using different ignition methods. Detonation signals are processed from those combustion events to determine the fuel ignition method that will result in maximum power with allowable engine wear for a given fuel. Although the '830 patent purports to have the flexibility to run on a wide variety of fuels, a great deal of complexity of design and control is required in order to accommodate a variety of different ignition modes including spark ignition, homogeneous charge compression ignition, compression ignition, and combinations of the different ignition modes. Tests must be administered at engine start such that the engine is essentially controlled to act as a laboratory for a period of time in order to determine the least engine damaging ignition method to use that will also yield the highest power output for a particular fuel. These required test periods and reconfiguration of the engine to accommodate different modes of ignition may increase operating costs and reduce the ability of the engine to adjust quickly to different qualities of fuel that may be obtained at each refueling. The '830 patent also does not provide a means for taking overall global goals for a fleet of vehicles or group of machines into consideration.

The wide range of different types of fuel and quality of the fuel that may be used by single fuel or multiple fuel engines makes it prohibitively expensive to test and verify an engine for this entire range of fuels. The different combustion characteristics of different types of fuel, and even for the same type of fuel obtained from different sources, creates a need for control systems that are able to automatically adjust for different fuels having different combustion characteristics while optimizing engine performance and simultaneously meeting overall fleet management goals to provide optimum merit to a customer at a job site.

The disclosed system is directed to overcoming one or more of the problems set forth above and/or other problems with existing technologies.

SUMMARY OF THE DISCLOSURE

According to an aspect of the present disclosure, a control system for a multiple fuel internal combustion engine on a machine in a fleet of machines includes a gas analyzer configured to measure in real-time one or more characteristics of a gaseous fuel being supplied to the engine, a fleet management data monitoring module, and a cylinder pressure sensor associated with one or more cylinders of the engine. The control system further includes a data collection module configured to receive real-time fuel characteristics measurements from the gas analyzer, fleet management data characteristic of one or more operational parameters, fuel usage, and performance results for machines in the fleet, and real-time cylinder pressure measurements from the cylinder pressure sensors. The control system also includes an engine electronic control module configured to calculate one or more actual combustion parameter values from the real-time cylinder pressure measurements, and compare the calculated one or more actual combustion parameter values for each cylinder to predetermined combustion parameter values to determine any difference therebetween. The predetermined combustion parameter values are derived independently from any actual combustion parameter values based on real-time sensor measurements. The engine electronic control module is also configured to assign weights to fuel characteristics data, cylinder pressure data, and fleet management data, and control at least one of fuel injection of the gaseous fuel and ignition timing based on the weighted data and any difference between the calculated actual combustion parameter values for each cylinder and the predetermined combustion parameter values.

According to another aspect of the present disclosure, a multiple fuel internal combustion engine in a machine of a fleet of machines is operable in a combined liquid and gaseous fuel mode. The engine includes a plurality of cylinders, a real-time cylinder pressure sensor associated with each of the plurality of cylinders, a gas composition and quality sensor associated with a supply of the gaseous fuel, a fleet management data collection module, a cylinder liner temperature sensor associated with each of the plurality of cylinders, a liquid fuel injection system, a gaseous fuel injection system, and a control system. The control system includes a data collection module configured to receive real-time cylinder liner temperatures, cylinder pressure measurements from each of the cylinder pressure sensors, calculate one or more actual combustion parameter values from the real-time cylinder pressure measurements, receive fuel composition and quality data, receive fleet management data, and assign weights to fuel composition and quality data, cylinder pressure data, cylinder liner temperature data, and fleet management data. An engine electronic control module is configured to receive the calculated one or more actual combustion parameter values from the data collection module and compare the calculated one or more actual combustion parameter values for each cylinder to predetermined combustion parameter values to determine any difference therebetween, wherein the predetermined combustion parameter values are derived independently from any actual combustion parameter values based on real-time sensor measurements. A process control module is configured to control at least one of fuel injection of the fuel supplied to each cylinder and ignition timing based on the weighted data and any difference between the calculated actual combustion parameter values for each cylinder and the predetermined combustion parameter values.

According to another aspect of the present disclosure, a method for controlling a multiple fuel internal combustion engine operable in at least a combination liquid and gaseous fuel mode may include receiving real-time fuel quality and composition data, real-time in-cylinder pressure measurements, and real-time cylinder liner temperature measurements from each of the cylinders of the multiple fuel internal combustion engine. The method may further include calculating one or more actual combustion parameter values for each of the cylinders based on the real-time measurements. The method may still further include receiving fleet management data related to overall global operating parameters and customer preferences associated with a plurality of machines that each include one or more of the multiple fuel internal combustion engines, assigning weights to the real-time data and the fleet management data, and comparing the calculated actual combustion parameter values for each cylinder to predetermined combustion parameter values to determine any difference therebetween, wherein the predetermined combustion parameter values are derived independently from any actual combustion parameter values based on real-time sensor measurements. The method may also include controlling one or more of fuel injection of at least a liquid fuel and a gaseous fuel, and ignition based at least in part on the weighted data and any difference between the calculated actual combustion parameter values for each cylinder and the predetermined combustion parameter values.

Other features and aspects of this disclosure will be apparent from the following description and the accompanying drawings.

DETAILED DESCRIPTION

Figure 1:
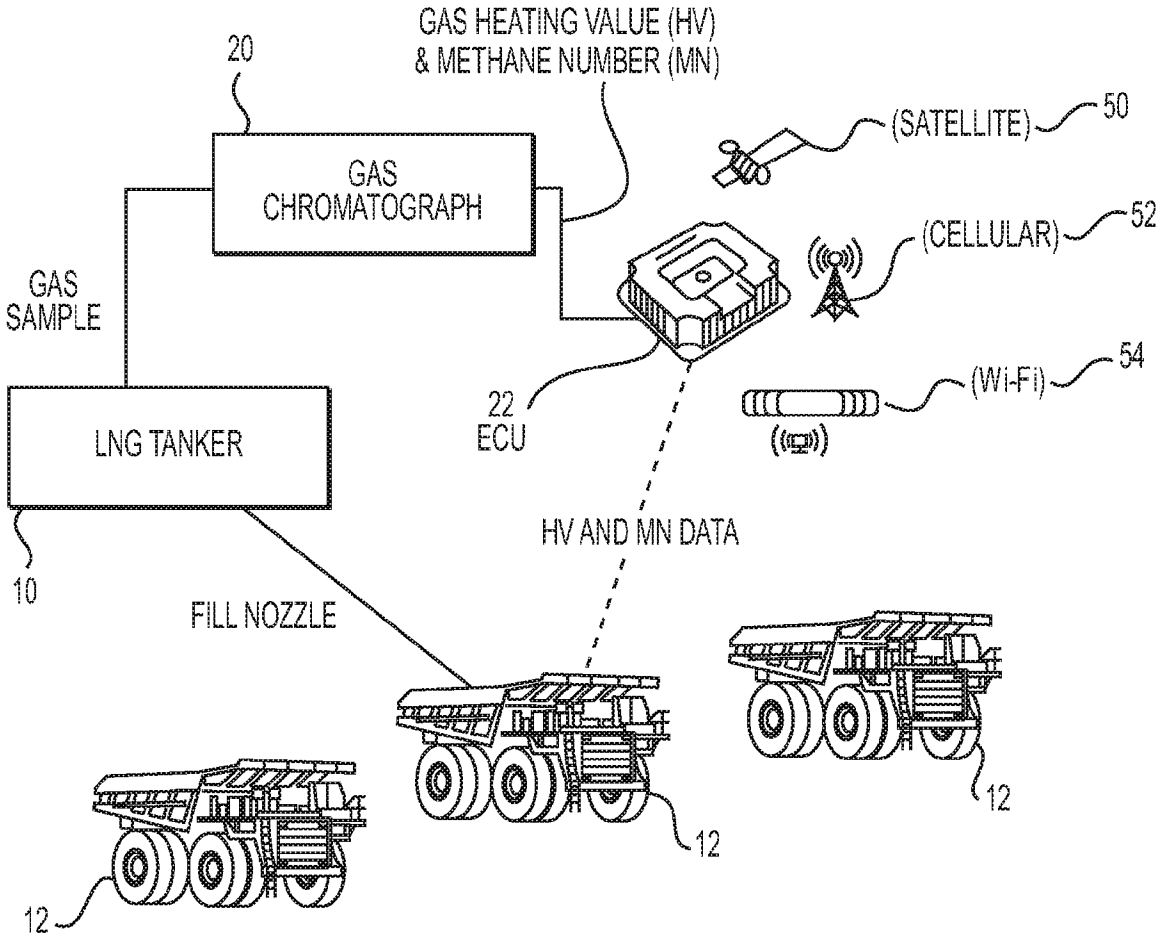
FIG. 1 shows an exemplary schematic diagram of a control system for providing gas composition and quality data for use in calibrating internal combustion engines in a fleet of vehicles.
Figure 2:
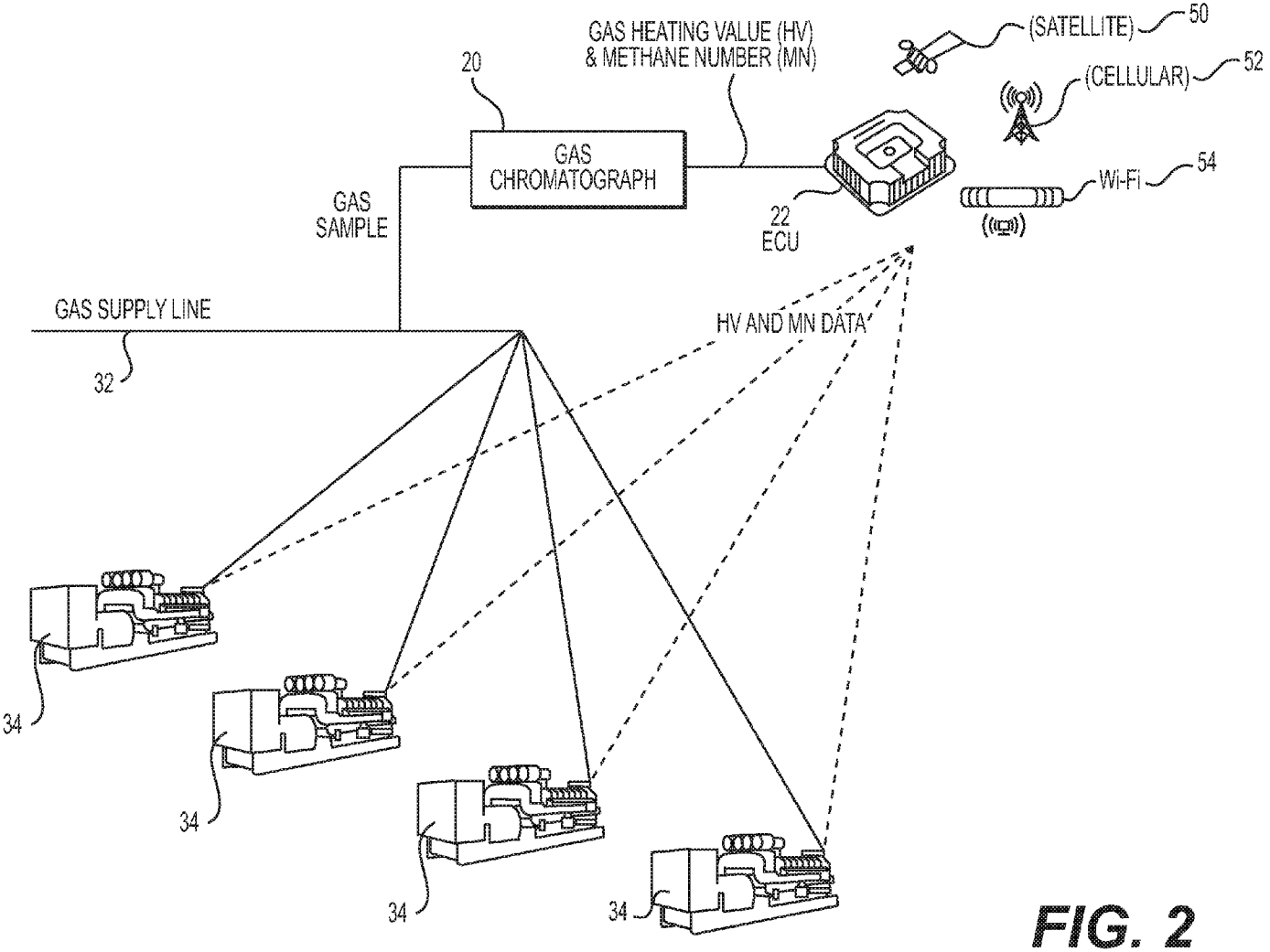
FIG. 2 shows an exemplary schematic diagram of a control system for providing gas composition and quality data for use in calibrating internal combustion engines of multiple stationary machines.

FIGS. 1 and 2 illustrate examples of control systems for providing fuel gas composition and quality data to each of a plurality of vehicles or other machines that each include one or more internal combustion engines. The term "fleet" as used herein refers to any group of two or more machines, such as mobile mining vehicles at a job site, marine engines on a plurality of vessels, or stationary power generating machines at a power generating plant.

In the exemplary control system illustrated in FIG. 1, gaseous fuel that may be supplied as one of multiple potential fuels to each of a plurality of earth-moving vehicles 12 or other mining vehicles at a job site may be pumped, for example, from a liquid natural gas (LNG) tanker 10 to each of the vehicles 12 when they are running low on fuel. A gaseous fuel composition and quality sensor such as a gas chromatograph 20 may be provided to take samples of the fuel from the LNG tanker 10 on a periodic or continuous basis. Alternatively or in addition, other types of gas composition and quality sensors such as infrared devices and microsensors may be communicatively coupled with the source of fuel for the vehicles 12. Examples of the characteristics of the fuel that may be determined by sensing devices such as the gas chromatograph 20 may include the methane number of the fuel, the lower heating value of the fuel, and the higher heating value of the fuel. Real-time measurements of the fuel characteristics may be communicated to one or more engine electronic control units (ECU) 22 that are associated with internal combustion engines on each of the vehicles 12 or stationary machines 34, such as illustrated in FIG. 2. The fuel characteristics may be communicated to each engine ECU from one or more sensing devices via satellite communication networks 50, cellular communication networks 52, Wi-Fi communication networks 54, or using other known communication networks.

Figure 3:
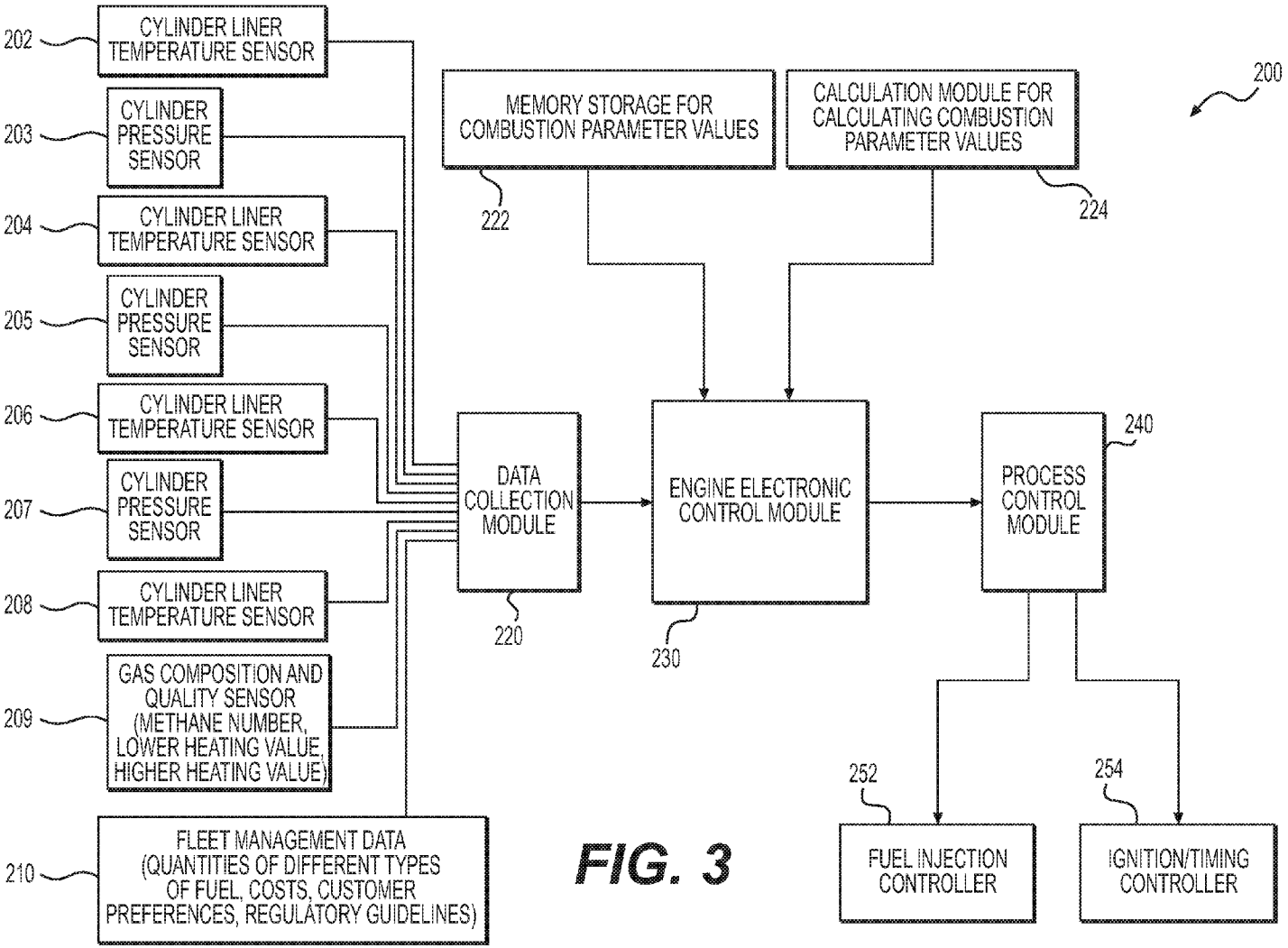
FIG. 3 shows an exemplary block diagram illustrating a control system for a multiple fuel internal combustion engine.

FIG. 3 shows a block diagram of an exemplary control system 200 for a multiple fuel internal combustion engine such as a homogeneous charge compression ignition (HCCI) engine that relies on auto-ignition for the initiation of combustion. Cylinder liner temperature sensors 202, 204, 206, 208, and cylinder pressure sensors 203, 205, 207 provide real-time data specific to combustion parameters within each combustion chamber of each engine to a data collection module 220. A gas analyzer such as gas composition and quality sensor 209 provides real-time data on fuel-specific characteristics such as the methane number of the fuel at any point in time, and lower and higher heating values for the fuel. As shown in FIGS. 1 and 2, the fuel may be sampled on a periodic or continuous basis from fuel being supplied, for example, through a gas supply line 32 to a plurality of stationary machines 34, as in FIG. 2, or from a tanker 10 holding a fuel, such as LNG, which is pumped on demand to a plurality of vehicles in a fleet of vehicles, as in FIG. 1. The sampled gas may be passed to one or more gas quality and/or composition sensors, such as the gas chromatograph 20. The sensor(s), in conjunction with one or more processors, may be configured to determine qualitative and quantitative characteristics of each gas sample in real-time. The gas characteristics may include the methane number, which may be used as an indication of the knock tendency of a particular fuel. Methane, which has a high knock resistance, is given an index value of 100, while hydrogen, which has a tendency to burn uncontrollably, is given an index value of 0. Other gas characteristics that may be determined include the lower heating value and the higher heating value for a particular fuel. The lower heating value (also known as the net calorific value) of a fuel is defined as the amount of heat released by combusting a specified quantity (initially at 25° C.) and returning the temperature of the combustion products to 150° C., which assumes the latent heat of vaporization of water in the reaction products is not recovered. The higher heating value (also known as the gross calorific value) of a fuel is defined as the amount of heat released by a specified quantity (initially at 25° C.) once it is combusted and the products have returned to a temperature of 25° C., which takes into account the latent heat of vaporization of water in the combustion products. The data derived by sensing devices such as the gas chromatograph 20, and associated with gas composition and quality may be communicated to the engine electronic control units (ECU) 22 located onboard each of the vehicles 12 or stationary machines 34 via the satellite networks 50, the cellular networks 52, the Wi-Fi networks 54, or other communication networks. In the exemplary control system 200 illustrated in FIG. 3, data from cylinder liner temperature sensors 202, 204, 206, 208, cylinder pressure sensors 203, 205, 207, gas composition and quality sensor 209, and fleet management data module 210 may be collected at the data collection module 220 for weighting or other further processing before being communicated to an engine electronic control module (ECM) 230. The data collection module 220 may be configured to calculate one or more actual combustion parameter values from the real-time cylinder pressure measurements.

By combining data collected in real-time on fuel characteristics with actual real-time measured combustion parameters such as in-cylinder temperatures and pressures, the control system 200 may enable instantaneous or nearly instantaneous adjustments to combustion phasing during each combustion cycle. Other data that may be collected and used by the control system 200 in order to make real-time determinations on whether adjustments should be made to various operational parameters may include exhaust temperatures, turbo speeds, compressor outlet temperatures, air-fuel ratios, etc. As one example, a sudden decrease in the measured methane number or heating value of a particular fuel being supplied to an engine may be immediately compensated for by adjusting the combustion phase for one or more cylinders in order to maintain specific combustion parameters such as in-cylinder pressures or temperatures at a level that maximizes efficiency of the engine and/or minimizes production of a pollutant such as $NO_R$. In some exemplary implementations, the timing of fuel injection of at least a portion of the fuel being supplied to each cylinder and/or the timing of ignition in each cylinder may be adjusted along with the timing of opening and closing of intake and exhaust valves, the amounts of fuel injected, the pressures of fuel injected, the amount of exhaust gas recirculation (EGR), and other operational control parameters in order to move the center of combustion, the start of combustion, the end of combustion, the rate of combustion, or other combustion parameters at least in part as a function of real-time fuel characteristics. The control system 200 may also be configured to complement these micro-level considerations based on combustion parameters measured within each cylinder of an engine for fine-tuning and calibrating the performance of each engine with macro-level considerations, such as fleet management goals and other customer-specified goals.

Figure 4:
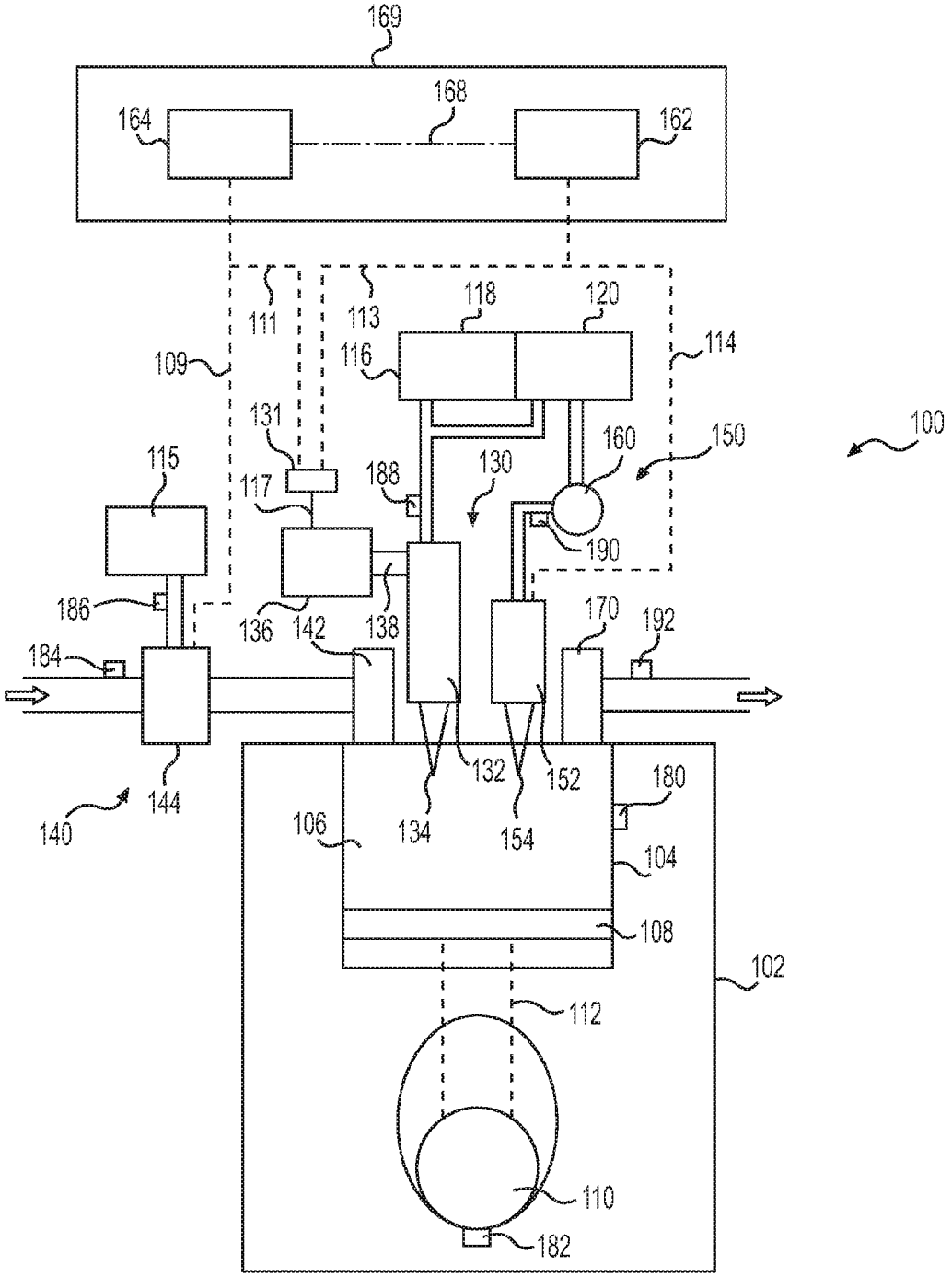
FIG. 4 illustrates an exemplary implementation of a multiple fuel internal combustion engine.

FIG. 4 is a schematic representation of an exemplary implementation of a multiple fuel internal combustion engine 100 that may be operated with different types of fuel, such as heavy fuel oil (HFO), diesel fuel, gasoline, and natural gas. The exemplary multiple fuel internal combustion engine 100 may be operated in a liquid fuel mode, a gaseous fuel mode, and a combination liquid and gaseous fuel mode.

During a liquid fuel mode, a liquid fuel injection system 130 provides liquid fuel to the charge air within a combustion chamber 106, and the charge air/liquid fuel mixture may be ignited by compression. Diesel engines and homogeneous charge compression ignition (HCCI) engines rely on auto-ignition for the initiation of combustion, in contrast to spark ignition engines such as gasoline powered engines. In a spark ignition engine auto-ignition is undesirable because it causes knock, and too much knock can create stresses on the engine that exceed an acceptable threshold level. The tendency of a fuel to auto-ignite is inversely proportional to the octane level of the fuel or the methane level of the fuel in the case of natural gas. In high performance, high compression spark ignition engines, a higher octane fuel may be required to avoid undesirable knock. Fuels for diesel engines and HCCI engines that rely on auto-ignition for initiation of combustion are typically given a cetane rating that is the direct opposite of the octane rating since the cetane rating is a measure of a fuel's tendency toward auto-ignition. Gaseous fuels such as CNG are more difficult to auto-ignite than diesel fuel, typically requiring a compression ratio for auto-ignition that may be more than ten times as high as a compression ratio that results in auto-ignition of a diesel fuel. Therefore, different methods of blending gaseous fuels with liquid fuels for ignition purposes have been developed. During a gaseous fuel mode, a gaseous fuel such as natural gas may be controllably released into an air intake port connected to a cylinder 104, producing a charge air/gaseous fuel mixture. In a combination liquid and gaseous fuel mode, after a predetermined period of time, a small amount of diesel fuel may be injected into the cylinder 104 containing a charge air/gaseous fuel mixture in order to ignite the fuel mixture. The amount of the diesel fuel used as an ignition fuel may be anywhere from 3-70% of the fuel amount injected during a liquid fuel mode. Compression ignites the diesel fuel, which in turn ignites the charge air/gaseous fuel mixture. To operate in a liquid fuel mode as well as a gaseous fuel mode, the control system for a multiple fuel internal combustion engine may control components of the liquid fuel injection system 130, a gaseous fuel injection system 140, and an ignition fuel injection system 150.

The combustion process in an HCCI engine depends strongly on factors such as cylinder charge composition, temperature, and pressure at the intake valve closing. Hence, the control inputs to the engine, for example, fuel mass and injection timing, and intake/exhaust valve profile, must be carefully coordinated to ensure robust auto-ignition combustion. Generally speaking, for best fuel economy, an HCCI engine operates unthrottled and with a lean air-fuel mixture. Further, in an HCCI engine using exhaust recompression valve strategy, the cylinder charge temperature is controlled by trapping different amounts of the hot residual gas from the previous cycle by varying the exhaust valve close timing. The HCCI engine may be equipped with one or more cylinder pressure sensors and a cylinder pressure processing unit which samples cylinder pressure from the sensors and calculates the combustion parameters such as the location during each cycle at which 50% of the fuel mass has been burned, and the indicated mean effective pressure (IMEP), among others. The objective of HCCI combustion control is to maintain desired combustion phasing by adjusting multiple inputs such as intake and exhaust valve timings, throttle position, exhaust gas recirculation (EGR) valve opening, injection timing, etc., in real-time. Thus, the cylinder pressure processing unit may employ sophisticated digital signal processing (DSP) chips to process the large amount of in-cylinder pressure measurements to generate combustion parameters in real-time. The cylinder pressure processing units may be incorporated into one or more processors included in the engine electronic control unit.

The engine 100 may be equipped with various additional sensing devices for monitoring engine operation. Such additional sensing devices may include a crank sensor 182 operative to monitor crankshaft rotational position, i.e., crank angle and speed. An exhaust gas sensor 192 may be configured to monitor exhaust gases. An air/fuel ratio sensor may provide additional data regarding the air/fuel ratio in real-time during combustion cycles. The cylinder pressure sensors 203, 205, 207 may be operative to monitor in-cylinder combustion pressure. The outputs of the various sensors may be collected by the data collection module 220.

In accordance with various implementations of this disclosure, the control system 200 may be configured to weight and combine data related to various combustion characteristics such as in-cylinder pressure and temperature measurements, data related to fuel composition and/or quality, and overall fleet management data. The fleet management data obtained from a fleet management data module 210 may be related to overall global operating parameters and performance goals; fuel types available at a particular work site; the age, condition, and types of the equipment included in the fleet; and customer preferences associated with a plurality of stationary or mobile machines that each include one or more of the multiple fuel internal combustion engines. Processors in the data collection module 220 and/or the engine ECM 230 may be configured to assign weights to the engine specific data and the fleet management data depending on customer preferences. For example, in some situations a customer may decide based on the price or availability of a particular type of fuel at a particular job site to assign more weight to fleet management goals, and overrule a determination by a particular engine ECM that substitution of that particular type of fuel would enhance performance of that engine. Other global considerations that may receive enhanced weighting by an engine ECM may include a customer's desire to reduce wear and tear on certain machines that are older than others in the fleet. The assigned weightings may also take repair costs and machine downtime into consideration, as well as safety considerations and regulatory requirements in order to maximize merit or value for a particular customer at a specific job site.

The engine ECM 230 may also be configured to compare the calculated actual combustion parameter values for each cylinder in each engine to predetermined combustion parameter values to determine any difference therebetween. The predetermined combustion parameter values may be theoretical values derived using physics-based calculations, or values based on historical data, empirical data, desired target data, etc. Combustion parameter values may be calculated in calculation module 224, and stored in memory storage 222. The combustion parameter values may be communicated to the engine ECM 230. Predetermined combustion parameter values may be derived independently from any actual combustion parameter values based on real-time sensor measurements. The predetermined combustion parameter values may also be set to be the same for each of the cylinders in an engine. The control system 200 may be configured to control one or more of fuel injection of at least a liquid fuel and a gaseous fuel, and ignition based on any difference between the calculated actual combustion parameter values for each cylinder and the predetermined combustion parameter values.

The predetermined combustion parameter values from the memory storage may be combustion parameter values based on a theoretical power output that the multiple fuel internal combustion engine can produce with the same types and quantities of fuel as are currently being combusted by the engine while staying within allowable stress or durability limits for the engine. The predetermined combustion parameter values from the memory storage may also be combustion parameter values based on a theoretical amount of emissions that the multiple fuel internal combustion engine will produce with the same types and quantities of fuel as are currently being combusted by the engine. The calculated one or more actual combustion parameter values and the predetermined combustion parameter values may include one or more of peak cylinder pressure, indicated mean effective pressure (IMEP), maximum heat released, crank angle of start of combustion, crank angle of center of combustion, and crank angle of opening or closing of an inlet or outlet valve for each of the cylinders of the multiple fuel internal combustion engine.

A process control module 240 may be configured to receive commands from the engine ECM 230 and send control signals to a fuel injection controller 252 and an ignition/timing controller 254 to implement real-time changes to operational characteristics in order to fine tune the calibration of each engine. Control signals may also be sent to any number of other controllers to implement real-time changes to the quantities and pressures of the different types of fuel, timing of valve openings and closings, amounts of exhaust gas recirculation, and other control parameters. Macro-level decisions may also be made at one or more central controllers associated with the fleet of machines based on data collected by the data collection module 220. The macro-level decisions include whether the composition and/or quality of a particular fuel available at any particular time and/or geographical location merits a decision to initiate a blanket reduction in the amount of that fuel supplied to the engines, or a change in the amount of one fuel that is substituted for another.

Referring again to the exemplary embodiment of an internal combustion engine 100 shown in FIG. 4, the fine tuning of the calibration of each engine 100 by the control system 200 illustrated in FIG. 3 may include adjusting combustion phasing, i.e., timing of combustion pressure relative to the crank angle of the crankshaft 110 for each cylinder 104 during each combustion cycle. One or more cylinder pressure sensors 180 can also be monitored by the engine ECM to determine a mean-effective-pressure (IMEP) for each cylinder 104 during each combustion cycle. The engine ECM monitors and determines states of IMEP for each of the engine cylinders 104 during each cylinder firing event.

The engine ECM may include any electronic control module, controller, processor, or other computing device(s) comprising various combinations of one or more Application Specific Integrated Circuit(s) (ASIC), Field-Programmable Gate Arrays (FPGA), electronic circuit(s), central processing unit(s), microprocessor(s) and associated memory and storage (read only, programmable read only, random access, hard drive, etc.) executing one or more software or firmware programs, combinational logic circuit(s), input/output circuit(s) and devices, appropriate signal conditioning and buffer circuitry, and other suitable components to provide the described functionality. The engine electronic control module (ECM) 230 shown in the exemplary embodiment of FIG. 3 includes a set of control algorithms, including resident software program instructions and calibrations stored in memory and executed to provide the desired functions. The algorithms may be executed during preset loop cycles. Algorithms are executed, such as by a central processing unit (CPU), and are operable to monitor inputs from the various sensing devices and other networked control modules, and execute control and diagnostic routines to control operation of various actuators. Loop cycles may be executed at regular intervals during ongoing engine and vehicle operation. Alternatively, algorithms may be executed in response to occurrence of an event. The engine ECM 230 is configured to receive data from the data collection module 220, from memory storage for combustion parameter values 222, and from calculation module 224 for calculating combustion parameter values.

In operation, the engine ECM 230 monitors inputs from the aforementioned sensors to determine states of engine parameters. The engine electronic control module 230 may also be configured to receive input signals from an operator (e.g., in the case of a mobile vehicle, via an accelerator pedal and a brake pedal) to determine a torque request. The torque request on a mobile vehicle can also be in response to an auto start condition monitored by the engine ECM. In various exemplary embodiments, the engine ECM monitors various sensors for cylinder pressures, temperatures, engine speed, intake air temperature, coolant temperature, and other ambient conditions. The ECM also executes algorithmic code stored therein to control various actuators to form the cylinder charge, including controlling throttle position, spark-ignition timing, fuel injection mass and timing, exhaust gas recirculation (EGR) valve position to control flow of recirculated exhaust gases, and intake and/or exhaust valve timing and phasing on engines so equipped. The ECM 230 can operate to turn the engine on and off during ongoing vehicle operation, and can operate to selectively deactivate a portion of the cylinders 104 or a portion of the intake and exhaust valves. The ECM can also control air/fuel ratio based upon feedback from an exhaust gas sensor.

Combustion control parameters may be generated in response to operator inputs to achieve various performance goals. However, cylinder-to-cylinder conditions can vary due to differences in the amount of air and recirculated exhaust gas distributed to each cylinder, resulting in combustion that is not the same in each cylinder even though theoretical combustion control parameters for each cylinder are identical. Utilizing the real-time fuel composition/quality data, in-cylinder pressure measurement data, and fleet management data collected by data collection module 220, real-time combustion balancing control and diagnostics during a combustion cycle can be achieved by providing adjustments to combustion control parameters for each cylinder in an engine on an individual basis. The adjusted combustion control parameters can provide stable and balanced combustion in each cylinder during an immediately subsequent combustion cycle in real time. Fuel injection and ignition timing strategies implemented by fuel injection controller 252 and ignition/timing controller 254 can stabilize and enhance robust combustion in cylinders on an individual basis. For example, when the engine is operating during a low load and low engine speed, the temperature of the cylinder charge can be increased by pre-injecting fuel into the combustion chamber. A determination of qualitative characteristics of the fuel in real-time based on data received from gas composition and quality sensor 209 can also inform control strategies and commands Specifically, a split fuel injection event can be utilized in respective cylinders to substantially achieve the target combustion parameter in each respective cylinder. When the engine is operating in auto-ignition (HCCI), the split fuel injection event may include delivering a first injection early in a compression stroke of a first portion of a fixed fuel mass and a second injection near top dead center of the compression stroke of a remaining minority of the fixed fuel mass. The first portion of the fixed fuel mass reforms due to pressure, temperature, and fuel quality during recompression and results in releasing heat energy and increasing the cylinder charge temperature. The cylinder charge having increased temperature auto-ignites from the second injection near top dead center (TDC) of the compression stroke of the remaining minority portion of the fixed fuel mass. The fixed fuel mass may include a fuel mass sufficient to provide residual heat adequate for generating a combustion parameter during an immediately subsequent engine cycle to substantially achieve a target combustion parameter.

Referring again to FIG. 4, the multiple fuel internal combustion engine 100 may include an engine unit, an air system, a fuel system, and a control system. The engine unit may include an engine block 102, at least one cylinder 104 providing at least one combustion chamber 106 for combusting fuel, a piston 108, and crank-shaft 110 connected to the piston 108 via a piston rod 112. The piston 108 may be configured to reciprocate within the cylinder 104.

In various implementations according to this disclosure, the multiple fuel internal combustion engine 100 may be used as a power source on an off-highway mining truck, a large marine vessel for propulsion, in a petroleum application such as well fracking or drilling, and other applications that may benefit from the flexibility offered by such engines. In some of these implementations the multiple fuel internal combustion engine may use multiple fuels in a fuel blending operation, such as the fuel control operation referenced by the trademarked DYNAMIC GAS BLENDING™ (DGB™) mode. A fuel control operation such as the DGB™ mode may be characterized by gaseous fuel being injected and mixed with air in the cylinders 104, and a subsequent injection of liquid fuel may ignite the air/gaseous fuel mixture. In alternative implementations of this disclosure, a single fuel engine such as a natural gas spark ignited engine may also be operated with different grades or qualities of natural gas.

The air system may include an inlet valve 142 fluidly connected to the at least one combustion chamber 106, and an outlet valve 170 also fluidly connected to the at least on combustion chamber 106. The inlet valve 142 may be configured to enable injection of compressed charge air and/or a mixture of compressed charge air and gaseous fuel into the at least one combustion chamber 106. After combusting the liquid fuel and/or gaseous fuel, the exhaust may be released out of the at least one combustion chamber 106 via the outlet valve 170 into an associated exhaust gas system (not shown) for treating the exhaust gas. In various exemplary implementations, a portion of the exhaust gas may be recirculated to one or more cylinders by an EGR control valve.

The fuel system may include a gaseous fuel tank 115 for storing the gaseous fuel, for example natural gas, and a liquid fuel tank unit 116, which may include a first liquid fuel tank 118 for storing, for example, HFO, or biodiesel oil, and a second liquid fuel tank 120 for storing, for example, diesel fuel. The fuel system may further include the liquid fuel injection system 130, the gaseous fuel injection system 140, and the ignition fuel injection system 150. The liquid fuel injection system 130 may be configured to inject liquid fuel originating from the liquid fuel tank unit 116 into the at least one combustion chamber 106. A liquid fuel injector 132 may be supplied with HFO, biodiesel oil, or other liquid fuel from the first liquid fuel tank 118 or with diesel fuel from the second liquid fuel tank 120.

The liquid fuel injector 132 may include a liquid fuel injector nozzle 134 fluidly communicating with the at least one combustion chamber 106. An actuator 136 controlled by a fuel injection controller such as the fuel injection controller 252 shown in FIG. 3 may be configured to control the amount of liquid fuel provided to the liquid fuel injector 132. In various exemplary embodiments the actuator 136 may be a mechanical actuator connected to the liquid fuel injector 132 via a fuel rack 138 for controlling the amount of injected liquid fuel, or more typically, an electrical solenoid actuator or piezoelectric actuator driven by a control signal received from an engine control unit.

The gaseous fuel injection system 140 may be configured to inject gaseous fuel originating from the gaseous fuel tank 115 into the at least one combustion chamber 106. The gaseous fuel injection system 140 may include a gas admission valve 144, for example a solenoid-actuated or electro-hydraulic-actuated gas admission valve, which may be arranged upstream of the inlet valve 142 and may be configured to mix gaseous fuel originating from the gaseous fuel tank 115 with compressed charge air. The mixture of gaseous fuel and compressed charge air may be injected into the at least one combustion chamber 106 via the inlet valve 142.

The ignition fuel injection system 150 may be configured to inject a small amount of liquid fuel, preferably diesel fuel or other high cetane fuel, into the at least one combustion chamber 106. The ignition fuel injection system 150 may include an ignition fuel injector 152 having an ignition fuel injector nozzle 154 that is in fluid communication with the at least one combustion chamber 106 and a common rail system 160 receiving diesel fuel from the second liquid fuel tank 120 of the liquid fuel tank 116. The ignition fuel injector 152 may be supplied with diesel fuel from the common rail system 160. In some implementations, the ignition fuel injection system 150 may be also configured to inject liquid fuel into the at least one combustion chamber 106 during the liquid fuel mode. This may prevent the ignition fuel injector nozzle 54 from being blocked by, for example, soot resulting from the combusting process. In various alternative implementations, fuel injectors may be provided that inject both gaseous fuel and diesel fuel according to a selected one of a plurality of combustion modes.

In one exemplary implementation, a control system may be configured to select between a fuel injection operation that includes high pressure direct injection of the fuel (such as the fuel injection mode referenced by the trademark HPDI™) and at least one gas blending mode. In the high pressure direct injection mode, high pressure gaseous fuel may be injected after a liquid fuel injection, igniting at some point during compression of the fuels. In the gas blending mode(s), gaseous fuel may be injected and mixed with air in the cylinder, and a subsequent injection of liquid fuel may ignite the air/gaseous fuel mixture. In some implementations, the control system may be configured to select between at least two gas blending modes, including the DYNAMIC GAS BLENDING™ (DGB™) mode.

The control system may comprise a control unit 169 including a first electronic control module 162, a second electronic control module 164, and several control lines connected to the respective components of the fuel system. The first electronic control module 162 may be connected to the second electronic control module 164 via a bus 168. One of ordinary skill in the art will recognize that in various alternative implementations one or more electronic control modules may be provided at one or more locations. The functions performed by the first and second electronic control modules of the exemplary implementation shown in FIG. 1 may be performed by a single engine electronic control module, or an engine electronic control module in conjunction with another process control module, such as the engine ECM 230 and process control module 240 shown in FIG. 3.

The first electronic control module 162 may be configured to control the liquid fuel mode of the multiple fuel internal combustion engine 100. Specifically, the first electronic control module 162 may be connected to the actuator 136 via a connection line 113 and a hardware connection, such as a relay 131. The hardware connection may also be embodied by multiple relays 131. The hardware connection may alternatively or in addition be embodied by a diode or by multiple diodes. Diodes may allow a continuous connection rather than a switched connection between the first electronic control module 162 and the fuel rack actuator 136.

During the liquid fuel mode, the first electronic control module 162 may provide a liquid fuel amount control signal to the fuel rack actuator 136 via the connection line 113. The liquid fuel amount control signal may indicate a desired liquid fuel amount to be injected into the at least one combustion chamber 106. In addition, the first electronic control module 162 may be configured to generally control the multiple fuel internal combustion engine 100 such as by controlling the engine speed and delivered fuel/power from the engine. Moreover, during the gaseous fuel mode, the first electronic control module 162 may be configured to control the ignition fuel injection system 150 via a connection line 114.

The second electronic control module 164 may be configured to control the gaseous fuel mode of the multiple fuel internal combustion engine 100. Specifically, the second electronic control module 164 may be connected to the gas admission valve 144 via a connection line 109. Furthermore, the second electronic control module 164 may be connected to the actuator 136 via a connection line 111 and the relay 131. During the gaseous fuel mode, the second electronic control module 164 may provide a gaseous fuel amount control signal to the gaseous admission valve 144 via the connection line 109. The gaseous fuel amount control signal may indicate a desired gaseous fuel amount to be mixed with compressed charge air within the gaseous admission valve 144, which mixture may be injected into the at least one combustion chamber 106. At the same time, the first electronic control module 162 may provide an ignition fuel amount control signal to the ignition fuel injector 152 via the connection line 114. The ignition fuel amount control signal may indicate a desired ignition fuel amount to be injected into the at least one combustion chamber 106 for igniting the gaseous mixture. For example, the small amount of injected ignition liquid fuel may be about 3% of the amount of injected liquid fuel during the liquid fuel mode. One of ordinary skill in the art will recognize that alternative implementations may include controlling the gas admission valve 144 by hydraulic and/or electrohydraulic means. The liquid fuel may also serve as the hydraulic fluid used to control actuation of the gas admission valve. The first and second electronic control modules 162, 164 may also control the timing of injections of liquid and gaseous fuels in a manner that controls when auto-ignition will occur.

Various embodiments of the disclosed control system may further include several sensors for measuring actual combustion parameter values of the multiple fuel internal combustion engine 100. For example, the control system may include the cylinder pressure sensor 180 for sensing the pressure within the at least one combustion chamber 106, a crank shaft speed sensor 182 for measuring the speed of the crank shaft 110, a charge air pressure sensor 184 for measuring the pressure of the compressed charge air, a gaseous fuel pressure sensor 186 for measuring the pressure of the gaseous fuel, a liquid fuel pressure sensor 188 for measuring the pressure of the liquid fuel, a common rail pressure sensor 190 for measuring the pressure of the liquid fuel within the common rail 160, and an exhaust gas pressure sensor 192 for measuring the pressure of the exhaust gas released out of the at least one combustion chamber 106. The control system may also include other sensors, such as rotational speed sensors, timing sensors, transmission gear position sensors, gas constituent sensors, and other sensors measuring various vehicle, engine, and combustion parameters.

As discussed above, FIG. 3 illustrates an exemplary implementation of a control system 200 according to this disclosure, wherein cylinder pressure sensors 203, 205, 207, cylinder liner temperature sensors 202, 204, 206, 208, a gas composition and quality sensor 209, and a source of fleet management data 210 all provide input to data collection module 220 and engine ECM 230 of the control system 200. One of ordinary skill in the art will recognize that a large variety of sensors measuring various engine operating and combustion parameters such as those discussed above may all provide input to the control system. In the exemplary implementation of FIG. 3, the cylinder-specific sensors may each be associated with a different cylinder of a multiple fuel internal combustion engine. Multiple cylinder pressure sensors may also be provided for each cylinder at different locations on each cylinder if desired. In certain alternative implementations it may be desirable to only instrument one cylinder with a cylinder pressure sensor in order to reduce costs. Data collection module 220 may be configured to receive the real-time cylinder pressure measurements, cylinder temperature measurements, fuel quality measurements, and fleet management data, and apply different weightings to the data depending on customer preferences. The data collection module 220 of the control system 200 may also be configured to calculate one or more actual combustion parameter values from the real-time cylinder pressure measurements received from the cylinder pressure sensors.

The engine electronic control module 230 of control system 200 may be configured to receive the calculated one or more actual combustion parameter values from the data collection module 220, and predetermined theoretical and calculated combustion parameter values from memory 222 and calculation module 224. ECM 230 may compare the calculated one or more actual combustion parameter values based on real-time sensory inputs for each cylinder to predetermined combustion parameter values to determine any difference therebetween, wherein the predetermined combustion parameter values are derived independently from any actual combustion parameter values based on real-time sensor measurements, and may be based on expected or theoretical combustion parameter values for the one or more types of fuel being combusted in each cylinder. In an alternative implementation wherein fewer than all of the cylinders are provided with a cylinder pressure sensor or other combustion parameter sensing device, the engine ECM 230 may be configured to compare the calculated actual combustion parameter values for the cylinders that are provided with cylinder pressure sensors to the predetermined combustion parameter values calculated from stored values.

The process control module 240 may be configured to control at least one of fuel injection of at least two different types of fuel supplied to each cylinder, and ignition timing in order to reduce any difference between the calculated actual combustion parameter values for each cylinder and the predetermined combustion parameter values. The fuel injection controller 252 may be configured to control both liquid fuel injection and gaseous fuel injection, such as performed by the first electronic control module 162 and the second electronic control module 164 in the exemplary implementation of FIG. 4. The ignition/timing controller 254 may be configured to implement the desired timing of ignition and/or fuel injection. Because there may be a delay between when an ignition fuel such as diesel fuel is first injected into the cylinder and when auto-ignition from compression actually begins, the timing of ignition may be controlled by the timing of injection of the ignition fuel. The engine ECU 230 may be configured to receive the predetermined combustion parameter values from one or more of the memory storage 222 and the calculation module 224. One of ordinary skill in the art will recognize that the various modules shown in the exemplary implementation of FIG. 2 may be combined into one or more processors, and embodied in one or more of software, hardware, firmware, or any combination thereof.

The coupling of real-time gas composition/quality data for the fuel being supplied to each cylinder with actual, real-time combustion parameter values determined within each cylinder facilitates fine tuning of the calibration of each engine to maximize efficiency and reduce emissions. The added input of fleet management data enables the control system to also incorporate macro-level considerations such as customer preferences based on the age and condition of particular machines within a fleet, costs and quality of different fuels available at specific job sites, and any regulatory considerations based on geographical location.

INDUSTRIAL APPLICABILITY

The disclosed control system is applicable to any fleet or grouping of machines with multiple fuel internal combustion engines or single fuel internal combustion engines, and enables implementation of desired operational characteristics such as optimizing the power output of the engines, increasing the longevity of the machines, minimizing fuel consumption, maximizing productivity, or reducing emissions, regardless of the fuel that is used. Fuel quality may vary widely for fuels of different types, and even for fuels of the same type, but obtained from different sources or at different times. Therefore, the disclosed systems and methods for automatically adjusting one or more of engine fueling, injection timing, or spark ignition in order to compensate for these variances may be beneficial. The coupling of real-time fuel composition and quality analysis with real-time combustion parameters within each cylinder of the engines and fleet management data enables the disclosed control system to make changes to many different operational parameters to maximize merit for a customer. Some of the operational parameters that may be effectively controlled by the disclosed systems include diesel injection timing, diesel fuel quantity, gas injection timing, gas quantity, diesel rail pressure, EGR percentages, air-fuel-ratio, and valve timing.

The use of greater amounts of gaseous fuel such as CNG in a multiple fuel internal combustion engine may impose higher stresses on the engine as a result of higher compression ratios and the potential for increased engine knock. Variations in physical and operational characteristics from one cylinder to another may result in limitations on the maximum amount of gaseous fuel that can be used. Different cylinders may produce different amounts of power, different levels of emissions, different amounts of knock, or other variables. As one example, a cylinder producing more knock than all of the other cylinders may be the limiting factor for how much gaseous fuel the engine may burn. Accurate, real-time measurement of actual combustion parameter values for each of the cylinders may allow for adjustments to controls for each cylinder in order to reduce any difference between actual combustion parameter values and predetermined combustion parameter values. Similarly, real-time measurement of fuel qualitative characteristics, when taken in conjunction with the measured actual combustion parameter values, further enhances robust control of the engines running on multiple vehicles or other machines being operated at any time. The predetermined combustion parameter values may be derived independently from any actual combustion parameter values based on real-time sensor measurements, and may be based on expected or theoretical combustion parameter values for the one or more types of fuel being combusted in each cylinder. The predetermined combustion parameter values may be combustion parameter values based on a theoretical power output that the multiple fuel internal combustion engine can produce with the same types and quantities of fuel as are currently being combusted by the engine. Alternatively or in addition, the predetermined combustion parameter values may be combustion parameter values based on a theoretical amount of emissions that the multiple fuel internal combustion engine can produce with the same types of fuel as are currently being combusted by the engine.

The calculated one or more actual combustion parameter values and the predetermined combustion parameter values, taken in conjunction with fuel characteristics measured by the fuel composition and quality sensors and fleet management data may be selected in order to allow for improvement of a desired characteristic such as the total power output of the engines, or reduction in the amount of emissions produced by the engines. Combustion parameter values may include peak cylinder pressure, indicated mean effective pressure (IMEP), maximum heat released, maximum rate of heat release, maximum rate of pressure rise, estimated combustion gas temperature, location of peak cylinder pressure, location of maximum rate of pressure rise, crank angle of start of combustion, crank angle of center of combustion, and crank angle of opening or closing of an inlet or outlet valve for each of the cylinders. Various combustion parameters, such as the crank angle of opening or closing of an inlet or outlet valve may be varied using engine control electronics. The predetermined combustion parameter values may be readily available values for each different type of fuel being used by an engine, based on theoretical, physics-based calculations, and may therefore enable a rapid initiation of a closed loop control to reduce any difference between the calculated actual combustion parameter values and the predetermined combustion parameter values. The accuracy of the predetermined combustion parameter values may also be improved as a result of the real-time data on fuel composition and quality.

A closed loop process may be initiated in order to rapidly determine optimal engine operating characteristics regardless of the characteristics of the fuel that is being used by the engine. Any one or more cylinders may be controlled in accordance with the closed loop process. For each cylinder, a predetermined combustion parameter value may be compared to a measured parameter value that has been calculated from an actual, real-time cylinder pressure measured by a cylinder pressure sensor for that cylinder. The results of that comparison may then be used to send signals to fueling and/or timing controllers. The fueling and/or timing controllers produce output commands, and new cylinder pressure readings are used to update the measured parameter values, which are again compared to the predetermined combustion parameter values. The timing controllers may alter timing of injection of fuels, timing of a spark in the case of a spark-ignited engine, and the timing of opening or closing of an inlet or outlet valve for each of the cylinders. The predetermined combustion parameter values against which any one or more of the cylinders may be evaluated may be selected from a calibration curve, map, or other data source. The predetermined combustion parameter values may have been derived from physics-based calculations, independently from any actual combustion parameter values based on real-time sensor measurements.

Alternative implementations may use a feed-forward process rather than a closed loop process. In the feed-forward process, measured cylinder pressure parameters may be correlated to well-known fuel descriptors such as cetane number, methane number, lower heating value, specific gravity, etc. These descriptors may be detected in real-time with gas characteristics sensors such as the gas composition and quality sensor 209 and/or entered manually into a service tool or via a GUI panel on the engine. These same fuel descriptors may be coupled with the cylinder pressure measurements obtained from one or more cylinder pressure sensors. A feed-forward control block may translate the fuel descriptors into fueling and/or timing adjustments using static maps, calculations or algorithms. A feed-forward process without a closed loop control may allow a fueling and/or timing controller to make an immediate adjustment to the system response based on knowledge of the engine's fuel characteristics.

In still further alternative implementations the feed-forward process may be used for some cylinder pressure parameters, and the closed loop process may be used for other cylinder pressure parameters. A control method that uses both feed-forward and closed loop processes may be desirable, for example, if certain cylinder pressure parameters are discovered to vary by small amounts in spite of large differences in fuel characteristics, while other cylinder pressure parameters are discovered to vary by large amounts as qualitative or quantitative characteristics of the fuel change. The cylinder pressure parameters that vary little with changes in fuel characteristics may be best suited for feed-forward processes, while cylinder pressure parameters that vary by large amounts as the fuel characteristics change may require a closed loop process of adjusting fueling and/or timing in order to provide accurate system response. The rates of execution of each of the feed-forward processes and closed loop processes may be different so as to not create an instability condition.

The process implemented by the control system 200 may be performed in a closed loop for any individual cylinder of the multiple fuel internal combustion engine. In the exemplary embodiment of FIG. 4, actual combustion parameter values may be calculated for one or more cylinders 104 from real-time cylinder pressure measurements taken by cylinder pressure sensors 180 in the one or more cylinders 104. These one or more actual combustion parameter values may then be compared to a predetermined combustion parameter value for the one or more types of fuel being used by the engine. Fueling and/or timing controllers may then produce fueling and/or timing output commands to control one or more of fuel injection of at least a liquid fuel and a gaseous fuel into each cylinder 104, and ignition of the fuel in each cylinder 104 in order to reduce any difference between the calculated actual combustion parameter values for each cylinder and the predetermined combustion parameter values. In the case of auto-ignition of the fuel, such as with diesel engines and HCCI engines, the timing of ignition may be controlled indirectly by the timing of injection of a pilot fuel such as diesel fuel, which will auto-ignite upon reaching a certain compression. Spark ignition engines control the timing of ignition by controlling the timing of the spark. This process may be continued in a closed loop until the difference between the calculated actual combustion parameter values for each cylinder and the predetermined combustion parameter values is less than a threshold level. The process for any one cylinder 104 may begin with a controller receiving real-time cylinder pressure measurements from one or more cylinder pressure sensors 180 located in the cylinder 104. Data collection module 220 may then calculate actual combustion parameter values based on the cylinder pressure measurements.

A comparison module may be incorporated into the engine electronic control module 230, and configured to compare the calculated actual combustion parameter values for each cylinder 104 to the same predetermined combustion parameter value used for all of the other cylinders 104. The comparison module may have received the predetermined combustion parameter values from a memory storage 222 or a calculation module 224. The calculation module 224 may be configured to derive the predetermined combustion parameter values independently from any actual combustion parameter values based on real-time sensor measurements. The predetermined combustion parameter values may be based on expected combustion parameter values for the one or more types of fuel being combusted in each cylinder. Expected combustion parameter values may have been calculated using known, physics-based calculations or algorithms based on the physical parameters of the engine, chemical characteristics of the type of fuel, and known thermodynamics of the combustion process for each type of fuel in an engine with known physical parameters.

When the difference between the calculated actual combustion parameter values for one or more cylinders and the predetermined combustion parameter values is above a desired threshold level, the process control module 240 may control one or more of engine fueling, fuel injection timing, and ignition timing for each of the cylinders 104 in order to attempt to bring the calculated actual combustion parameter values into line with the predetermined combustion parameter values. The process may be continued in a closed loop after controlling operational parameters for each cylinder 104 and again receiving real-time cylinder pressure measurements for each cylinder 104, along with real-time fuel characteristics data, and fleet management data.

It will be apparent to those skilled in the art that various modifications and variations can be made to the disclosed control system. Other embodiments will be apparent to those skilled in the art from consideration of the specification and practice of the disclosed concepts. It is intended that the specification and examples be considered as exemplary only, with a true scope being indicated by the following claims and their equivalents.

The invention claimed is:

1. A control system for a multiple fuel internal combustion engine on a machine in a fleet of machines, the control system comprising:

a gas analyzer configured to monitor in real-time one or more characteristics of a gaseous fuel being supplied to the engine;

a fleet management data monitoring module;

a cylinder pressure sensor associated with one or more cylinders of the engine;

a data collection module configured to receive:

real-time fuel characteristics measurements from the gas analyzer;

fleet management data characteristic of one or more operational parameters, fuel usage, and performance results for machines in the fleet; and real-time cylinder pressure measurements from the cylinder pressure sensors; and an engine electronic control module configured to:

calculate one or more actual combustion parameter values from the real-time cylinder pressure measurements;

compare the calculated one or more actual combustion parameter values for each cylinder to predetermined combustion parameter values to determine any difference therebetween, wherein the predetermined combustion parameter values are derived independently from any actual combustion parameter values based on real-time sensor measurements;

assign weights to fuel characteristics data, cylinder pressure data, and fleet management data; and control at least one of fuel injection of the gaseous fuel and ignition timing based on the weighted data and any difference between the calculated actual combustion parameter values for each cylinder and the predetermined combustion parameter values.

2. The control system of claim 1, wherein the engine electronic control module is further configured to receive the predetermined combustion parameter values from a memory storage.

3. The control system of claim 2, wherein the predetermined combustion parameter values from the memory storage are combustion parameter values based on a theoretical power output that the multiple fuel internal combustion engine can produce with the same types and quantities of fuel as are currently being combusted by the engine while staying within allowable stress limits for the engine.

4. The control system of claim 2, wherein the predetermined combustion parameter values from the memory storage are combustion parameter values based on a theoretical amount of emissions that the multiple fuel internal combustion engine will produce with the same types and quantities of fuel as are currently being combusted by the engine.

5. The control system of claim 1, wherein the calculated one or more actual combustion parameter values and the predetermined combustion parameter values include one or more of peak cylinder pressure, indicated mean effective pressure (IMEP), maximum heat released, crank angle of start of combustion, crank angle of center of combustion, and crank angle of opening or closing of an inlet or outlet valve for each of the cylinders of the multiple fuel internal combustion engine.

6. The control system of claim 5, wherein the predetermined combustion parameter values are combustion parameter values based on a theoretical power output that the multiple fuel internal combustion engine can produce with the same types and quantities of fuel as are currently being combusted by the engine.

7. The control system of claim 1, wherein the engine electronic control module is further configured to control the timing of one or more of fuel injection of at least two different types of fuel and ignition of the at least two different types of fuel.

8. The control system of claim 1, further including the engine electronic control module being configured to recalculate one or more actual combustion parameter values from new real-time cylinder pressure measurements taken after the engine electronic control module controls fuel injection of at least two different types of fuel in order to reduce any difference between the calculated actual combustion parameter values for each cylinder and the predetermined combustion parameter values, the recalculation by the engine electronic control module continuing in a closed loop process until the difference between the calculated actual combustion parameter values and the predetermined combustion parameter values is less than a predetermined threshold.

9. The control system of claim 1, wherein the engine electronic control module is further configured to receive the predetermined combustion parameter values from a calculation module configured to calculate the predetermined combustion parameter values using known, physics-based calculations based on the physical parameters of the engine, real-time characteristics of the fuel, and known thermodynamics of the combustion process for each type of fuel being used by the multiple fuel internal combustion engine.

10. A multiple fuel internal combustion engine in a machine of a fleet of machines, the engine operable in a combined liquid and gaseous fuel mode, comprising:

a plurality of cylinders;

a real-time cylinder pressure sensor associated with each of the plurality of cylinders;

a gas composition and quality sensor associated with a supply of the gaseous fuel;

a fleet management data collection module;

a cylinder liner temperature sensor associated with each of the plurality of cylinders;

a liquid fuel injection system;

a gaseous fuel injection system; and a control system, the control system comprising:

a data collection module configured to receive real-time cylinder pressure measurements from each of the cylinder pressure sensors, calculate one or more actual combustion parameter values from the real-time cylinder pressure measurements, receive fleet management data, and assign weights to fuel composition and quality data, cylinder pressure data, cylinder liner temperature data, and fleet management data;

an engine electronic control module configured to receive the calculated one or more actual combustion parameter values from the data collection module and compare the calculated one or more actual combustion parameter values for each cylinder to predetermined combustion parameter values to determine any difference therebetween, wherein the predetermined combustion parameter values are derived independently from any actual combustion parameter values based on real-time sensor measurements; and a process control module configured to control fuel injection of the fuel supplied to each cylinder based on the weighted data and any difference between the calculated actual combustion parameter values for each cylinder and the predetermined combustion parameter values.

11. The multiple fuel internal combustion engine of claim 10, wherein the engine electronic control module is further configured to receive the predetermined combustion parameter values from a memory storage.

12. The multiple fuel internal combustion engine of claim 11, wherein the predetermined combustion parameter values from the memory storage are combustion parameter values based on a theoretical power output that the multiple fuel internal combustion engine can produce with the same types and quantities of fuel as are currently being combusted by the engine while staying within allowable stress limits for the engine.

13. The multiple fuel internal combustion engine of claim 11, wherein the predetermined combustion parameter values from the memory storage are combustion parameter values based on a theoretical amount of emissions that the multiple fuel internal combustion engine will produce with the same types and quantities of fuel as are currently being combusted by the engine.

14. The multiple fuel internal combustion engine of claim 10, wherein the calculated one or more actual combustion parameter values and the predetermined combustion parameter values include one or more of peak cylinder pressure, indicated mean effective pressure (IMEP), maximum heat released, crank angle of start of combustion, crank angle of center of combustion, and crank angle of opening or closing of an inlet or outlet valve for each of the cylinders of the engine.

15. The multiple fuel internal combustion engine of claim 14, wherein the predetermined combustion parameter values are combustion parameter values based on a theoretical power output that the multiple fuel internal combustion engine can produce with the same types and quantities of fuel as are currently being combusted by the engine while staying within allowable stress limits for the engine.

16. The multiple fuel internal combustion engine of claim 10, wherein the process control module is further configured to control the timing of one or more of fuel injection of at least two different types of fuel and ignition of the at least two different types of fuel.

17. The multiple fuel internal combustion engine of claim 10, further including the data collection module being configured to recalculate one or more actual combustion parameter values from new real-time cylinder pressure measurements taken after the process control module controls one or more of fuel injection and ignition in order to reduce any difference between the calculated actual combustion parameter values for each cylinder and the predetermined combustion parameter values, the recalculation by the data collection module continuing in a closed loop process until the difference between the calculated actual combustion parameter values and the predetermined combustion parameter values is less than a predetermined threshold.

18. The multiple fuel internal combustion engine of claim 10, wherein the engine electronic control module is further configured to receive the predetermined combustion parameter values from a calculation module configured to calculate the predetermined combustion parameter values using known, physics-based calculations based on physical parameters of the engine, real-time characteristics of the fuel, and known thermodynamics of a combustion process for each type of fuel being used by the multiple fuel internal combustion engine.

19. A method for controlling a multiple fuel internal combustion engine operable in at least a combination liquid and gaseous fuel mode, the method comprising:

receiving real-time fuel composition and quality data;

receiving real-time in-cylinder pressure measurement data;

receiving real-time cylinder liner temperature measurement data from each of the cylinders of the multiple fuel internal combustion engine;

calculating one or more actual combustion parameter values based on the real-time measurement data;

receiving fleet management data related to overall global operating parameters and customer preferences associated with a plurality of machines that each include one or more of the multiple fuel internal combustion engines;

assigning weights to the real-time data and the fleet management data;

comparing the calculated actual combustion parameter values for each cylinder to predetermined combustion parameter values to determine any difference therebetween, wherein the predetermined combustion parameter values are derived independently from any actual combustion parameter values based on real-time sensor measurements; and controlling one or more of fuel injection of at least a liquid fuel and a gaseous fuel, and ignition based at least in part on the weighted data and any difference between the calculated actual combustion parameter values for each cylinder and the predetermined combustion parameter values.

20. The method of claim 19, wherein the predetermined combustion parameter values are combustion parameter values based on a theoretical power output that the multiple fuel internal combustion engine can produce with the same types and quantities of fuel as are currently being combusted by the engine while staying within allowable stress limits for the engine.

* * * * *